US006782566B2

(12) United States Patent
Gedouin

(10) Patent No.: US 6,782,566 B2
(45) Date of Patent: Aug. 31, 2004

(54) ENCLOSURE COMPRISING A FUNCTIONAL BATHTUB UNDERNEATH A HOOD

(75) Inventor: Jean Gedouin, Saint-Malo (FR)

(73) Assignee: TTS Concept Sarl, Saint-Malo Cedex (FR)

( * ) Notice: Subject to any disclaimer, the term of this patent is extended or adjusted under 35 U.S.C. 154(b) by 0 days.

(21) Appl. No.: 10/169,556

(22) PCT Filed: Dec. 22, 2000

(86) PCT No.: PCT/FR00/03659

§ 371 (c)(1),
(2), (4) Date: Nov. 1, 2002

(87) PCT Pub. No.: WO01/49238

PCT Pub. Date: Jul. 12, 2001

(65) Prior Publication Data

US 2003/0088911 A1 May 15, 2003

(30) Foreign Application Priority Data

Jan. 7, 2000 (FR) ..... 00 00211

(51) Int. Cl.[7] ..... A61H 33/06

(52) U.S. Cl. ..... 4/524; 4/536; 607/82; 607/83; 601/156

(58) Field of Search ..... 4/524, 525, 535, 4/536, 528–530; 607/81–86; 601/156, 159, 160

(56) References Cited

U.S. PATENT DOCUMENTS

| | | | | | |
|---|---|---|---|---|---|
| 1,643,528 | A | * | 9/1927 | Thurston | 607/80 |
| 2,292,666 | A | | 8/1942 | Schurtz | |
| 2,300,455 | A | | 11/1942 | Lukats | |
| 2,640,201 | A | * | 6/1953 | Burwell | 4/525 |
| 4,055,863 | A | * | 11/1977 | Duval | 4/601 |
| 4,130,120 | A | | 12/1978 | Kohler, Jr. | |
| 5,468,234 | A | | 11/1995 | Griffin et al. | |
| 5,645,578 | A | | 7/1997 | Daffer et al. | |
| 6,418,573 | B1 | * | 7/2002 | Masuda | 4/538 |
| 6,623,511 | B1 | * | 9/2003 | Daffer et al. | 607/82 |

FOREIGN PATENT DOCUMENTS

| | | |
|---|---|---|
| FR | 2 602 314 | 2/1988 |
| FR | 2 661 827 | 11/1991 |
| FR | 2 730 633 | 8/1996 |
| WO | WO 97/03633 | 2/1997 |

* cited by examiner

*Primary Examiner*—Huyen Le
(74) *Attorney, Agent, or Firm*—Lowe Hauptman Gilman & Berner, LLP

(57) ABSTRACT

An enclosure including a quasi-bathtub embedded in a structure and underneath a treatment hood has a shallow, substantially rectangular, practically flat bottom and a longitudinal basin extending from the head side. The basin is and has less depth than the tub. Air evacuation ports are on a ledge of the tub and air intake ports slightly project above the upper ledge of the tub. A semi-cylindrical, removable hood fits on the upper ledge of the tub. A blower is connected between the evacuation ports and air intake ports. Pivoting manifolds are connected to laterally orientable shower heads. Red and blue lights are alternately on for stimulation and relaxation, respectively.

18 Claims, 3 Drawing Sheets

ENCLOSURE COMPRISING A FUNCTIONAL BATHTUB UNDERNEATH A HOOD

The present invention relates to an enclosure composed of a quasi-bathtub underneath a removable hood, said enclosure being used for weight-loss, conditioning or relaxation treatments.

The French patent document 2 661 827 A of the state of the art discloses a weight-loss structure combining weight-loss treatment by perspiration with conditioning by exposure to algae. A patient stretches out within this structure and is covered with algae and subjected to an ambient temperature sufficiently high to assure perspiration, namely being between 40 and 70° C. This structure used in weight-loss treatment allows keeping up a comparatively high temperature for a long enough time without requiring excessive heating power.

However this structure entails the drawback of unique treatment application and illustratively it cannot be used for particular or conventional balneotherapy. However, and in particular as regards many relaxation treatments, application of light and/or sound has been recommended as being especially effective when combined for instance with applying water jets to the body.

It is known moreover from various statistics and scientific reports that the weight-loss treatments for both men and women may entail substantial psychological disorders.

Accordingly it is the objective of the present invention to create an enclosure comprising a quasi-bathtub underneath a removable hood and allowing implementing the above mentioned treatments in all their modes and to resolve the technical problems inherent in such apparatus, in particular patient safety during the various treatment stages and to support the patient's psychic equilibrium.

In one feature of the present invention, the enclosure comprising a quasi-bathtub underneath a treatment hood, comprises:

- a shallow and substantially rectangular quasi-bathtub embedded in a structure and with a practically flat bottom and of which the lengthwise basin is extended at the patient-head side by a central clearance in the ledge of said tub which is fitted with air intake and with air evacuation ports slightly projecting above the level of the upper ledge of said tub,
- a semi-cylindrical and removable hood that fits onto the upper tub ledge, and
- a blower unit connected between air evacuation and air intake ports,
- a multiple color light source,
- also one or several arrays of shower heads, said heads being pivotable and orientable, in particular laterally, and
- alternating red or blue light generators, red light being applied in the stimulatory stages and blue light hi the relaxation stages.

In another feature of the present invention, and besides a fan for air flow, the blower unit also includes a water heater of which the output may enter a conduit between the blower output and the air intake ports.

In another feature of the invention, the blower unit also includes essential oil diffusers and a diffuser of concentrated active ingredients that issue into said conduit using control means such as a feed valve.

In another feature of the invention, the blower unit also includes a liquid-algae diffusion unit and a concentrated-seawater diffusion unit which, in parallel, issue into said conduit and implement simultaneous or alternating diffusions controlled by feed valves.

In another feature of the invention, tile bottom of said tub's basin is fitted with shallow canals receiving the patient's arms, spinal column and legs and being fitted with pressurized water jets.

In still another feature of the invention, said jets are controlled with respect to excess pressure and frequency of application.

In still another feature of the invention, said enclosure is fitted with sound generators.

In still another feature of the invention, said structure includes a buffer basin fed by the drain(s) and feeding as needed said jets and said showers in continuous operation.

In another feature of the invention, said water heater includes a water electric-resistors exchanger of which the electric resistors are powered as a functional of a temperature detected by a sensors The above and other features of the invention shall be elucidated in the following description of an illustrative embodiment and in relation to the attached drawings.

Figure 1:
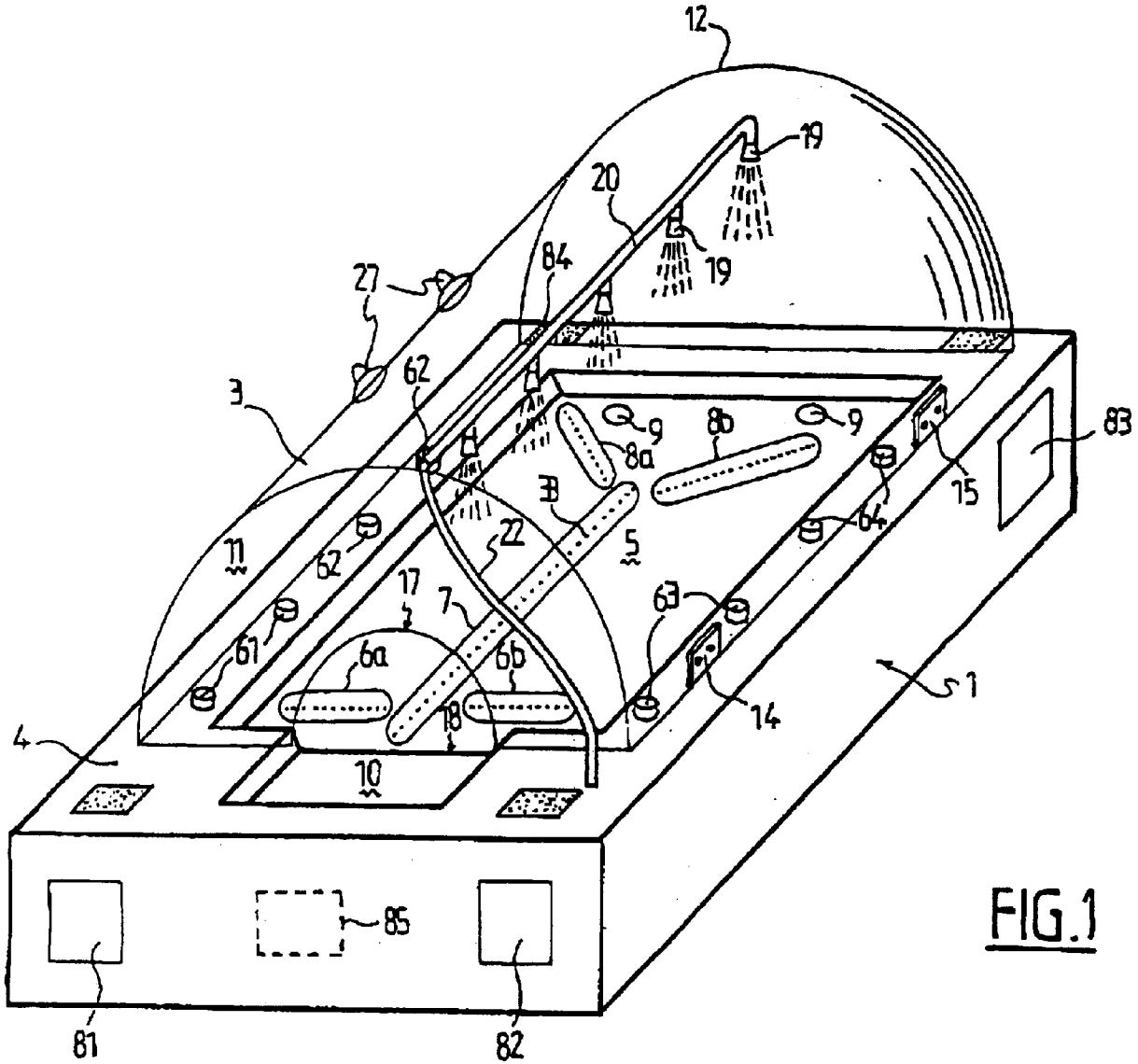
FIG. 1 is a perspective of an enclosure consisting of a quasi bathtub underneath a removable hood of the invention.

In FIG. 1, the enclosure of the invention consists of a substantially parallelipipedic structure 1 approximately several tens of cm high wherein is embedded a rectangular bath tub 2 above which is mounted a removable hood 3 which in its operational closed position shall rest on the bathtub's ledge.

The upper ledge of the tub 2 includes a substantially rectangular horizontal frame 4 enclosing an elongated and shallow basin 5. The bottom of the basin 5 slightly slopes from head to foot and comprises hollows constituting five canals 6*a*, 6*b*, 7, 8*a* and 8*b* which are configured to practically conform to a human being's rear shape. Two canals 6*a* and 6*b* are configured toward the head to receive the patient's shoulders and scapulae and run parallel to a small side of the basin 5. A central longitudinal canal 7 runs parallel to the large sides of the basin 5 and receives the patient's spinal column. Toward the feet, the oblique and diverging canals 8*a* and 8*b* receive the patient's lower members. At the rear, the bottom of the basin 5 is fitted with at least one, preferably two drains 9. A clearance 10 of lesser depth than the basin 5 is fitted into the frame 4 on the head's side to receive the rear of the head.

The removable hood 3 is designed to come down onto the tub 2 and seal it and assumes a substantially semi-cylindrical shape in the longitudinal direction, its semi-cylindrical wall terminating on the tub's frame 4 by a rectangular support resting on said frame 4. The length and the width of said rectangular support manifestly are slightly larger than those of the basin 5. At its two ends, the hood 3 is closed by a front wall 11 and a rear wall 12, said walls preferably being slightly convex. Said hood advantageously may be made of an optionally transparent plastic such as plexiglass or polyester. Preferably the support structure of the hood 3 is made of stainless steel to enhance strength and reliability of the assembly.

The hood 3 is mounted onto one long side of the frame 4 by two hinges 14 and 15 having longitudinal axes. Optionally fitted with jacks, these hinges allow frequent pivoting to open and close the hood without degrading it. The hood 3 may pivot on these hinges and assume either an open or a closed position. In this closed position, the lower support structure of hood 3 makes contact with the frame 4 of the structure 1 to constitute a sealed enclosure above the basin 5. In the open position, the basin 5 is accessible to the ambience.

A semi-circular opening 17 having a diameter substantially equal to the width of the clearance 10 is cut out of the center of the wall 11. When hood 3 is closed, the opening 17 is situated in the vertical plane of the inner rim of the clearance 10 which in turn is situated in the vertical plane of the inner rim 18 of the clearance 10 which thereby is situated outside the enclosure subtended by the hood 3.

A row of pivoting shower heads 19 is mounted on a manifold 20 at the upper generatrix of the hood 3, said manifold being firmly joined to the hood 3. The shower heads 19 are regularly arrayed along the manifold 20; illustratively there are five of them. They are directed approximately toward the center of the basin 5 and they spread enough water to sprinkle tile full width of the basin 5. Said showerheads also may be orientable to allow application to specific patient sites in the manner discussed further below. The manifold 20 is connected at the front to a flexible conduit 22 in order not damage the pivoting excursion of the hood 3. In another embodiment mode, several shower head manifolds similar to 20 are used.

The hood 3 is fitted with at least one or several light sources 27 affixed to the upper lateral parts. Illustratively two light sources 27 may be mounted on one side of the hood as shown in FIG. 1. These light sources 27 are equidistant from each other to avoid leaving any zone unilluminated during use. For safety the light sources are powered at low voltage. They are alternating red or blue light bulbs. A red color will be projected during stimulation stages and a blue color during relaxation stages according to a previously defined program. Advantageously the light sources are energized through optic fibers.

Figure 2:
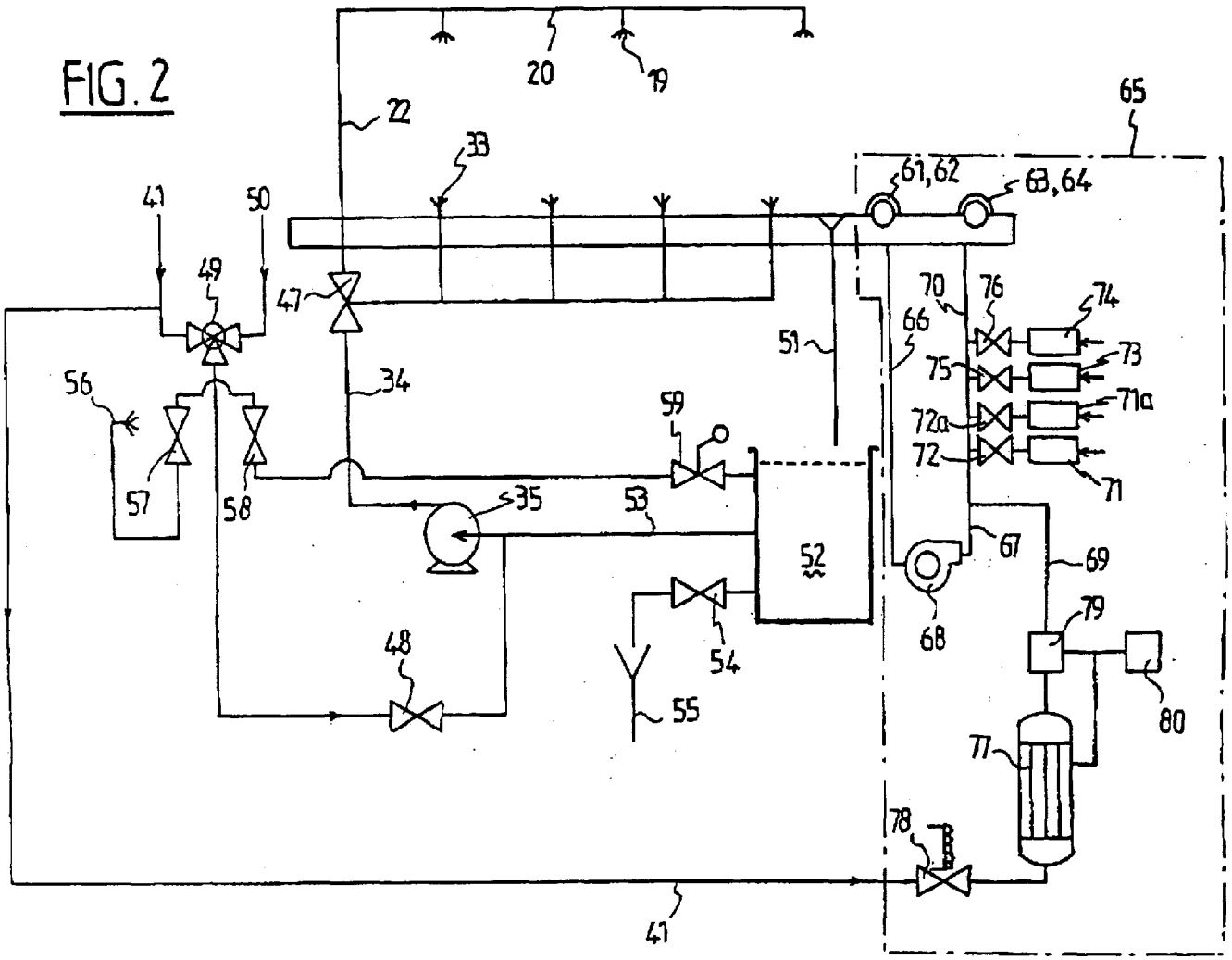
FIG. 2 is a functional diagram of the implements operating the enclosure of the invention.
Figure 3:
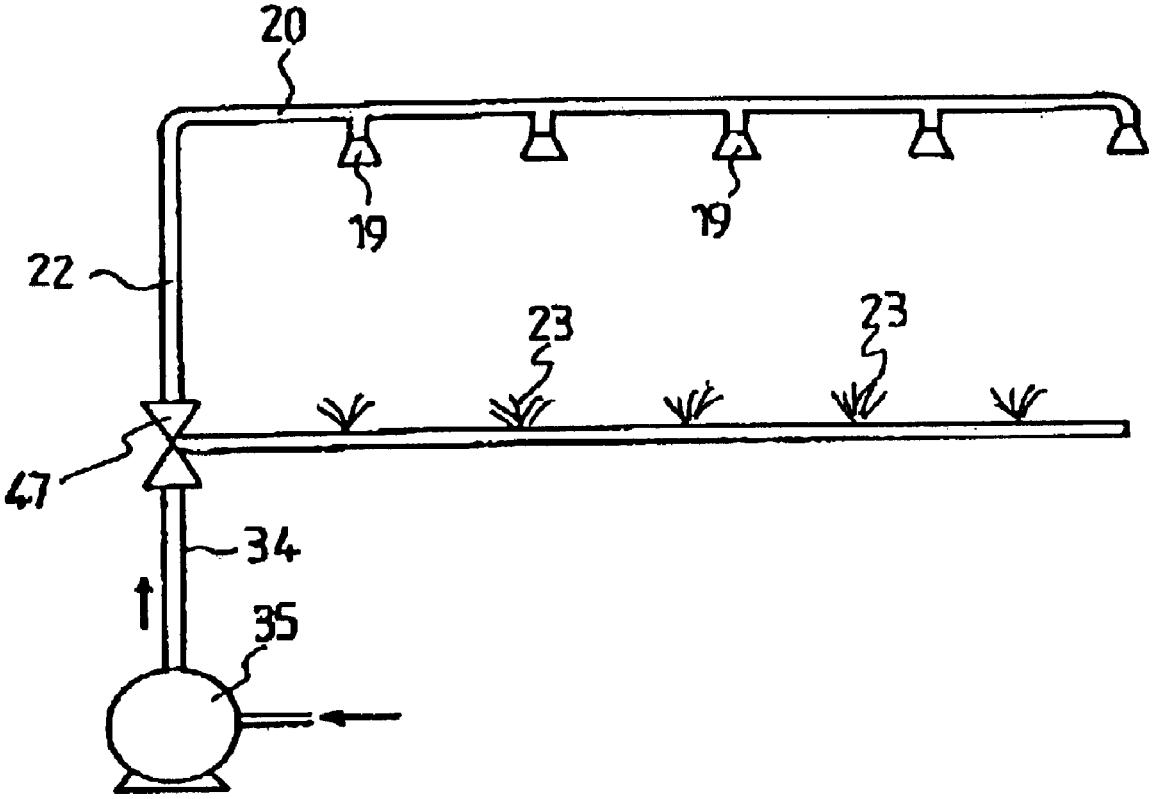
FIG. 3 is a schematic view of one feature of the invention.

The canals 6*a*, 6*b*, 7, 8*a*, 8*b* are fitted with apertures for vertical jets 33 which are fed from a manifold 34 shown in FIG. 2 which is connected to the conduit 22 (FIGS. 1, 2) and supplied with water by a pump 35. Preferably a feed valve 47 is mounted on the manifold 34 at the branching site of the conduit 22. This valve 47 allows sequentially or continuously massaging from the feet to the chest and/or from the heel to the nape. The pump 35 is fed through an electric valve 48 which in turn is connected to a thermostatic mixing valve 49. The mixing valve 49 is supplied with hot water from the conduit 41 and with cold water from the conduit 50.

In order to save water, the drain 9 is connected through a tube 51 to a buffer receptacle 52 whereby the water from the shower heads 19 and from the jets 33 may be recovered. The buffer receptacle 52 is fitted with an outlet 53 connected directly to the feed pump 35. In this manner the hot-water application may take place in closed loop. An electric valve 54 allowing to drain through a tube 55 is provided to drain the receptacle 52.

An electric float valve 59 with which to operate a rinsing head 56 is mounted at one output of the buffer receptacle 52 to rinse the patient or the bed, and feed valves 57 and 58 are mounted between the electric valve 53 and the shower head 56.

Two pairs of longitudinal blower ports 61, 62 and 63, 64, where 61, 63 are configured near the head and 62, 64 near the feet, are configured slightly above the surface of the frame 4 at each long side of the tub 2 and within the enclosure subtended by the closed hood 3. The ports 61, 62 evacuate air from the hood 3 and the ports 63, 64 are air intake ports. The air evacuation ports 61 and 62 and the air intake ports 63 and 64 respectively are connected to a conventional blower unit 65 which ordinarily shall be housed in the structure 1 underneath the bath tub 2.

The blower unit 65 is shown in FIG. 2. It includes a suction intake 66 and an outlet 67 connected to one another by a turbine ventilator 68, the output of which is connected the water output of an electric heater 69. The intake 66 is connected in parallel to the evacuation ports 61 and 62 of FIG. 1. The outlet 67 is connected to a conduit 70 running to the air intake ports 63 and 64 of FIG. 1.

Both an essential-oils diffuser 71 and a diffuser 71*a* of concentrated active ingredients are connected to the conduit 70 of the blower unit 65 which is regulated by feed valves 72, 72*a* of which the operating modes are described below.

Again a diffusion unit 73 of liquid algae and a concentrated-seawater unit 74 are connected in parallel to the conduit 70 and assure simultaneous or alternating diffusion regulated by feed valves 75 and 76.

An electric heater 77 also is connected to the conduit 70 and in turn is fed from the hot-water conduit 41 An electric valve 78 is mounted between the hot-water conduit 41 and the electric heater 77.

A temperature sensor 79 is mounted between the electric heater 77 and the blower 68. Said sensor is connected to a regulation unit 80 which, depending on a predetermined temperature value, turns on or off the electric heater 77. Illustratively if the temperature picked up by the sensor 79 is less than the setpoint temperature value the regulation unit 80 turns on the heater 77, and inversely, when the temperature is higher, unit turns off heater 77. In this manner the temperature inside the enclosure subtended by the hood 3 shall be equilibrated at a given value which is the setpoint value. Said setpoint temperature value advantageously shall be between 35 and 400° C. and preferably it shall be about 38° C.

It is understood that the conduit 70 that feeds compressed air to the ports 63 and 64 acts as an atomizer tube, in other words, it atomizes microparticles of water suspensions, essential oils, concentrated active ingredients, liquid state algae, seawater concentrate, that may be fed to it through 71, 73, 74 and 77.

A stop button for general shutdown in case of problems during treatment has been provided for safety. Illustratively said button is mounted on the ledge 2.

Acoustic generators to emit acoustic waves inside the enclosure composed of a quasi bathtub underneath a hood also are used. Such generators consist of one or more loudspeakers 81, 82, 83 and 84 mounted in the structure 1 underneath the tub 2 for instance at the structure's four corners and connected to a sound source of the (omitted) CD output. An appropriate control unit 85 is used to sequentially or simultaneously drive the various implements discussed above.

The operation of the enclosure of the invention shall now be described. The hood 3 being open, the patient lies down inside the tub 2, the head in the headrest formed by clearance 10 and back and legs resting in the bottom canals designed for that purpose in the basin 5. Once appropriately in place, the patient's body and members are covered with algae and then the hood 3 is closed and the blower unit is turned ON.

The microparticles blown by the blower unit 65 are expelled through the intake ports 63 and 64 into the enclosure constituted by the hood 3 above the basin 5. These microparticles move along the contour of the hood 3, from the intake port 63 to the evacuation port 61 and from the port 64 to the port 62. From the ports 61 and 62 they are re-aspirated by the blower unit 65.

When passing into the enclosure underneath the hood 3, part of the heat was transferred to the patient of whom thereupon the skin pores dilate and who hence shall perspire. The patient does so while being clad in a fresh-alga product and thereby said patient combines a weight-loss treatment with a conditioning treatment. Other cladding substances may be used for special treatments.

The above described unit 65 allows maintaining a constant temperature within the hood 3 at reduced electric power consumption.

After a predetermined time, the unit 65 is shut OFF, the hood 3 is opened, and the temperature within the enclosure is allowed to fall to ambient temperature. Then the hood 3 is closed again and the patient is washed clean of algae by means of the shower heads 19.

After the water has run over the patient, it drains into the bottom of the basin 5 and into the canals 6*a,* 6*b,* 7, 8*a* and 8*b* where it drains on account of the slope toward the drain 9.

During said showering, the patient's body also is washed by the jets 33 designed into the canals 6*a,* 6*b,* 7, 8*a* and 8*b*.

Omitted means are used to prevent water from penetrating the ports 61 through 64.

This second stage may be followed for instance in the sequential mode by a third stage of acoustic and light treatments. These acoustic and light treatments are controlled by a conventional electronic system.

Lastly the fourth program stage may include diffusing essential oils using the above described means to make the patient comfortable.

In another illustrative embodiment, the bottom of the basin 5 is devoid of the above described canals. However the configuration of this bottom is similar to an embossed mattress without vertical jets.

One of the advantages of the above described invention is to virtually eliminate calcium deposits because hot water is being produced. Also the means cleaning the conduits are optimized to avoid stagnation of various deposits that might cause circuit clogging or bad odors.

It must be borne in mind that by its design the above described bathtub-hood enclosure allows all treatment stages to be carried out in alternating or simultaneous manner and boosts the patient's well being during the cure. This new bathtub-hood assembly makes it easier for the treating personnel and maximum sanitation is offered by its cleaning.

This enclosure of the invention also is fitted with acoustic and light devices described above to be used in various antistress treatments and more generally in treating various difficulties relating to modern life.

What is claimed is:

1. An enclosure comprising: a quasi-bathtub embedded in a structure and having a shallow, substantially rectangular and practically flat bottom, the quasi-bathtub having a longitudinal basin extending from a head side and including a centered clearance of lesser depth, air evacuation ports being fitted on an upper ledge of said tub and air intake ports slightly projecting above the upper ledge of said tub, a semi-cylindrical and removable hood fitting on the upper ledge of the tub a blower unit connected between air evacuation ports and air intake ports, one or more manifolds connected to pivotable and laterally orientable shower heads, and an arrangement for alternatingly emitting red and blue light, the red light being used for stimulatory stages and the blue light for relaxation stages, a blower unit in addition to a blower for providing air circulation underneath said hood including a water heater having an output arranged to be selectively coupled into a conduit configured between the blower output and the air intake ports.

2. Enclosure as claimed in claim 1, wherein the blower unit furthermore includes an essential-oils diffuser and a concentrated active-ingredients diffuser having an output selectively coupled into said conduit.

3. Enclosure as claimed in claim 2 wherein said water heater comprises a water/electric-resistors heat exchanger having electric resistors adapted to be controlled by a temperature sensed by a detector.

4. Enclosure as claimed in claim 2 further including a controller for said diffuser.

5. Enclosure as claimed in claim 4 wherein said controller for the diffuser includes a feed valve.

6. The enclosure of claim 2, further comprising a headrest for receiving the head of a subject.

7. Enclosure as claimed in claim 1 wherein the blower unit furthermore includes a diffusion unit for selectively supplying liquid algae simultaneously or alternately and a concentrated-seawater into said conduit.

8. The enclosure of claim 7, further comprising a headrest for receiving the head of a subject.

9. Enclosure as claimed in claim 1 wherein the basin has a bottom including shallow canals to receive the subject's arms, spinal column and legs, said canals being fitted with pressurized water jets.

10. The enclosure of claim 9, further comprising a headrest for receiving the head of a subject.

11. Enclosure as claimed in claim 9, further including a controller for the pressure and frequency of emission of water from said jets.

12. The enclosure of claim 11, further comprising a headrest for receiving the head of a subject.

13. Enclosure as claimed in claim 1, wherein said structure includes a buffer basin fed by the drain(s) for feeding said jets and said showers for continuous operation.

14. The enclosure of claim 13, further comprising a headrest for receiving the head of a subject.

15. Enclosure as claimed in claim 1 wherein the wavelengths are for red and blue visible optical energy.

16. The enclosure of claim 1 wherein the blower unit is arranged for providing air circulation underneath said hood.

17. The enclosure of claim 16 wherein the blower unit includes a water heater having an output arranged to be selectively coupled into a conduit configured between the blower output and the air intake port.

18. The enclosure of claim 1, further comprising a headrest for receiving the head of a subject.

* * * * *